United States Patent [19]

Weldon

[11] 4,063,851

[45] Dec. 20, 1977

[54] COOLABLE TURBINE AIRFOIL

[75] Inventor: Howard Aubrey Weldon, Tolland, Conn.

[73] Assignee: United Technologies Corporation, Hartford, Conn.

[21] Appl. No.: 643,567

[22] Filed: Dec. 22, 1975

[51] Int. Cl.[2] ..... F01D 5/18

[52] U.S. Cl. ..... 416/97 A; 415/115

[58] Field of Search ..... 416/95–97, 416/115

[56] References Cited

U.S. PATENT DOCUMENTS

| | | | |
|---|---|---|---|
| 3,369,792 | 2/1968 | Kraimer et al. | 416/97 X |
| 3,388,888 | 6/1968 | Kercher et al. | 416/97 X |
| 3,628,880 | 12/1971 | Smuland et al. | 415/115 |
| 3,799,696 | 3/1974 | Redman | 416/97 |
| 3,930,748 | 1/1976 | Redman et al. | 416/97 A |
| 3,994,622 | 11/1976 | Schultz et al. | 416/97 R |

*Primary Examiner*—Everette A. Powell, Jr.
*Attorney, Agent, or Firm*—Robert C. Walker

[57] ABSTRACT

An airfoil cooling system for use in a gas turbine engine having high turbine inlet temperatures is disclosed. Various construction details designed to prevent thermal deterioration are developed. The system is built around impingement, film, and convective cooling techniques which are combined to limit the temperature of the airfoil material and to reduce thermal gradients within the component.

10 Claims, 2 Drawing Figures

COOLABLE TURBINE AIRFOIL

BACKGROUND OF THE INVENTION

1. Field of the Invention

The present invention relates to gas turbine engines and more particularly to airfoils used in engines having high turbine inlet temperatures.

2. Description of the Prior Art

The design and construction of gas turbine engines has always required precise engineering effort to ensure the structural integrity of the individual components. One particularly critical area for concern is the turbine nozzle which is formed of a plurality of vanes disposed across the flow path for the working medium gases. During operation of the engine, the flowing medium is redirected by the nozzle onto the rotor blades of the turbine wheel. The temperature of the medium at the inlet to the turbine normally exceeds the allowable temperature limit of the material from which the vanes are fabricated. Conventionally, the vanes are cooled to prolong their service life by reducing the temperature of the vane material during operation.

In most constructions vane cooling air is directed from the compressor, through various conduit means both inwardly and outwardly of the working medium flow path and to the turbine section of the engine. A hollow cavity within the airfoil section of each vane receives the cooling air. Air entry ports at both ends of the hollow cavity are in communication with the conduit means. A typical vane utilized in a cooled turbine is shown in U.S. patent application, Ser. No. 531,632, entitled, "Cooled Turbine Vanes" by Leogrande et al, of common assignee herewith. In Leogrande a U-shaped insert is disposed within a hollow cavity at the leading edge of the airfoil section. The cooling air is accelerated and directed by small diameter holes in the insert to velocities at which the flow impinges upon the cavity walls. The air is subsequently flowed over the outer walls of the airfoil section to film cool the outer surfaces of the vane.

Film cooling requires a precise, relatively low pressure differential across the flow emitting holes. If the pressure differential is too high, the emitted flow penetrates the passing medium and is directed downstream with the combustion gases without adhering to the airfoil surface. On the other hand, if the pressure differential is too small, the hot medium gases penetrate the cooling air layer adjacent the vane and cause destructive heating of the vane material. Because the required pressure differential between the working medium gases and the cooling air within the vane cavity is relatively small, the amount of flow over the walls is highly sensitive to local pressure deviations within the cavity.

To implement the conjunctive use of impingement and film cooling, continuing efforts are being directed to provide apparatus which will isolate cooling air to the pressure side chambers of the vane from cooling air to the suction side chambers of the vane.

SUMMARY OF THE INVENTION

A primary aim of the present invention is to provide a coolable airfoil having improved service life. Apparatus capable of establishing an adhering flow of cooling air over the exterior walls of the airfoil is sought. One goal in sustaining adhering flow is the maintenance of a substantially uniform pressure differential across the walls of the airfoil between the working medium gases of the flow path and the cooling air of the internal chambers.

The present application is predicated upon the recognition that the pressure of the working medium gases varies with medium position along the exterior walls of the turbine airfoils. Specifically, the pressure of the medium adjacent to the suction side of the airfoil is less than the pressure of the medium adjacent to the pressure side of the airfoil. Both pressures decrease in the downstream direction as the medium flows from the leading edge to the trailing edge of the airfoil. The cooling requirements of the airfoil are most critical in the region of the leading edge where the working medium pressures are the highest and the thermal environment is the most severe. A positive and measured flow of cooling air must exude from the leading edge to protect the airfoil from thermal degradation.

According to the present invention, a first, plate-like baffle is trapped within the hollow cavity of a coolable airfoil at a position adjacent to but spaced apart from the suction side wall forming a suction side chamber from which cooling air is flowable to the exterior surface of the suction side wall, and a second plate-like baffle is trapped within the hollow cavity at a position adjacent to but spaced apart from the pressure side wall forming a pressure side chamber from which cooling air is flowable to the exterior surface of the pressure side wall.

In one embodiment of the invention, a coolable airfoil has a downstream, second hollow cavity including disposed therein a second, suction side baffle and a second, pressure side baffle which are operatively disposed within the downstream cavity to form a second, suction side chamber and a second, pressure side chamber.

Primary features of the present invention are the suction side chambers from which cooling air is flowable over the exterior surface of the suction side wall and the pressure side chambers from which cooling air is flowable over the exterior surface of the pressure side wall. In combination with the cooling air holes of the airfoil walls, the impingement orifices in the suction side baffles and the pressure side baffles are adapted to maintain a cooling air pressure within each suction side chamber which is less than the cooling air pressure within the corresponding pressure side chamber. A sealing rib isolates the pressure side chamber of one cavity from the corresponding suction side chamber to prevent the leakage of cooling air therebetween.

A principal advantage of the present invention is improved airfoil cooling. Impingement cooling and convective cooling techniques within the airfoil cavities are effectively combined with film cooling of the exterior surfaces to inhibit thermal degradation of the airfoil. The flow characteristics of the cooling air which exudes from the leading edge, pressure side wall and suction side wall holes are optimized by establishing of a nearly uniform pressure differential across the airfoil walls. The cross flow of cooling air between the pressure side and suction side chambers of an internal cavity is prevented by isolating the chambers. In one embodiment a sealing rib separating the suction side and pressure side chambers is positioned remotely from the leading edge at the suction side wall where the airfoil cooling requirements are less severe.

The foregoing, and other objects, features and advantages of the present invention will become more apparent in the light of the following detailed description of the preferred embodiment thereof as shown in the accompanying drawing.

DESCRIPTION OF THE PREFERRED EMBODIMENT

Figure 1:
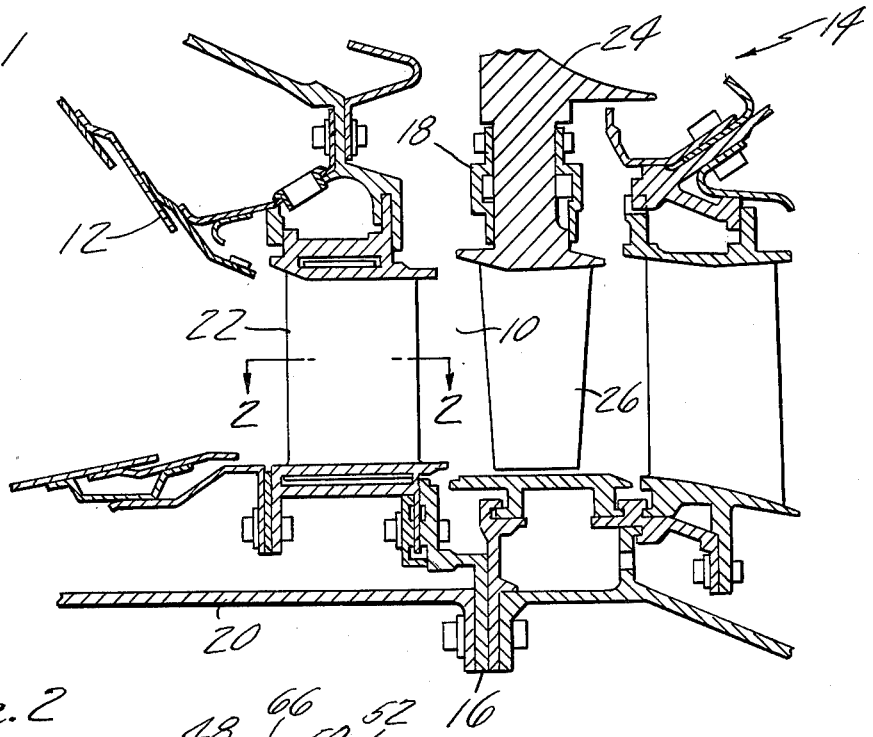
FIG. 1 is a simplified cross section view of a portion of the turbine section of a gas turbine engine.

A portion of the gas turbine engine is shown in cross section in FIG. 1. A flow path 10 for the working medium gases of the engine extends axially through the portion of the engine shown. Air and fuel are burned in a combustion chamber 12 to add thermal energy to the medium gases flowing therethrough. The effluent from the chamber is discharged in the downstream direction onto a turbine section 14. The turbine section is formed of a stationary or stator assembly 16 and a rotating or rotor assembly 18. The stator assembly has a case 20 which is located radially outward of the flow path and a plurality of stator vanes, as represented by the single vane 22, which extend inwardly from the case and across the flow path. The rotor assembly includes a rotor disk 24 and a plurality of rotor blades, as represented by the single blade 26, which extend outwardly across the flow path from the periphery of the disk.

Figure 2:
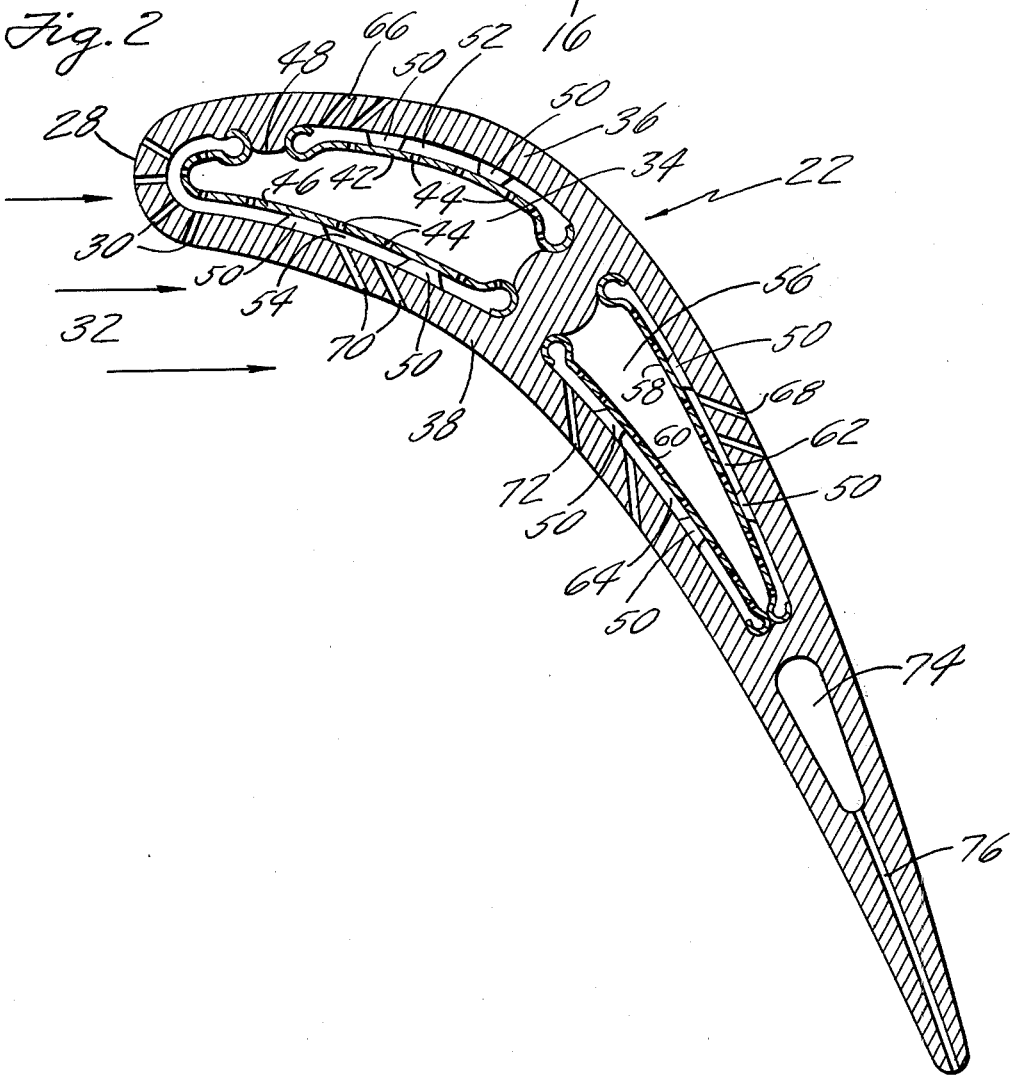
FIG. 2 is a simplified sectional view taken along the line 2—2 as shown in FIG. 1.

The FIG. 2 cross sectional view of the vane 22 reveals the features of the internal and external structure. A leading edge 28 having incorporated therein a plurality of leading edge holes 30 is positioned at the upstream end of the vane with respect to the approaching flow 32. A hollow cavity 34 is formed between a suction side wall 26 and a pressure side wall 38.

A plate-like, suction side baffle 42 is disposed within the cavity 34 and is spaced closely apart from the suction side wall. A multiplicity of impingement orifices 44 are incorporated within the baffle 42. A plate-like, pressure side baffle 46 is disposed within the cavity 34 and is spaced closely apart from the pressure side wall. A multiplicity of impingement orifices 44 are incorporated within the baffle 46. A sealing rib 48 separates the suction side baffle from the pressure side baffle. A multiplicity of stand-offs 50 hold the baffles apart from the cavity walls.

A suction side chamber 52 is formed between the suction side baffle 42 and the suction side wall 36. A pressure side chamber 54 is formed between the pressure side baffle 46 and the pressure side wall 38.

In the construction shown, a second hollow cavity 56 is formed between the suction side wall 36 and the pressure side wall 38 at a location downstream of the first hollow cavity 34. Within the cavity 56 a plate-like, suction side baffle 58 is spaced closely apart from the suction side wall and a plate-like, pressure side baffle 60 is spaced closely apart from the pressure side wall. A downstream suction side chamber 62 and a downstream pressure side chamber 64 are formed within the second hollow cavity 56 and correspond to the pressure side and suction side chambers of the first hollow cavity 34. A first set of suction side holes 66 lead from the suction side chamber 52 and a second set of suction side holes 68 lead from the suction side chamber 62. A first set of pressure side holes 70 lead from the pressure side chamber 54 and a second set of pressure side holes 72 lead from the pressure side chamber 64.

A third hollow cavity 74 having trailing edge holes 76 extending therefrom is shown at the trailing edge of the vane.

During operation of the engine, cooling air is flowable to the hollow cavities for cooling the vane. The air which is directed through the orifices 44 to the respective chambers is accelerated to velocities at which the air impinges upon the opposing walls. At the zones of impinging flow the heat transfer characteristics between the walls and the cooling medium are improved when compared to conventional convective cooling systems. The baffles perform the additional function of confining the cooling medium to the wall region for convective cooling of the walls.

The leading edge holes 30, the suction side holes 66 and 68, and the pressure side holes 70 and 72 are positioned about the vane so as to cause cooling air emitted therefrom to flow over the exterior of the suction side and pressure side walls. The holes and the impingement orifices 44 are sized and spaced so as to establish a substantially uniform pressure differential across the vane walls.

At each cavity the pressure of the cooling air within the pressure side chamber is greater than the pressure of the cooling within the suction side chamber. Similarly, the pressure within each successively downstream pressure side chamber is less than the pressure of the air within the upstream chamber. In this manner the pressure profile at the interior of the vane walls is made to conform to the pressure profile in the working medium flow path along the exterior of the vane. The extent of conformity depends in each individual engine upon the number of cavities utilized. In a construction wherein a particularly high degree of correspondence is required the number of cavities is increased.

The concepts described in this section of the specification have been applied to a turbine vane. The concepts, however, are equally applicable to other coolable airfoils such as rotor blades. A particularly key element in implementing the concepts disclosed is the separation of the pressure side and suction side chambers. Any leakage from the pressure to the suction chamber not only decreases the exuding velocities of the film cooling air over the pressure side surfaces but also increases the exuding velocity of the film cooling air over the suction side surface. This unpredicable deviation in pressure differential is substantially eliminated by the present construction.

Although the invention has been shown and described with respect to a preferred embodiment thereof, it should be understood by those skilled in the art that various changes and omissions in the form and detail thereof may be made therein without departing from the spirit and the scope of the invention.

Having thus described a typical embodiment of my invention, that which I claim as new and desire to secure by Letters Patent of the United States is:

1. A coolable airfoil structure, comprising:
   an airfoil shaped member having incorporated therein
   a hollow cavity and having
   a leading edge including a plurality of leading edge holes disposed therein,
   a suction side wall including a plurality of suction side holes disposed therein,
   a pressure side wall including a plurality of pressure side holes disposed therein, and a span-wise extending rib which projects into the cavity from the suction side wall between the suction side holes and the pressure side holes;

a plate-like pressure side baffle disposed within the cavity and spaced closely apart from the pressure side wall forming a pressure side chamber between the pressure side baffle and the pressure side wall wherein cooling air is flowable through said chamber from the cavity to the pressure side holes and to the leading edge holes; and a plate-like suction side baffle disposed within the cavity and spaced closely apart from the suction side wall forming a suction side chamber between the suction side baffle and the suction side wall wherein cooling air is flowable through said chamber from the cavity to the suction side holes, and wherein said pressure side baffle and said suction side baffle terminate at and are separated by said span-wise extending rib.

2. The invention according to claim 1 which further includes means for establishing a cooling air pressure within the pressure side chamber which is in excess of the pressure within the suction side chamber.

3. The invention according to claim 2 wherein said means for establishing a cooling air pressure within the pressure side chamber which is in excess of the pressure within the suction side chamber includes a multiplicity of impingement cooling orifices, disposed within said pressure side baffle and said suction side baffle, which are sized and spaced relative to the pressure side holes and suction side holes respectively to obtain said difference in pressure between the pressure side chamber and the suction side chamber.

4. The invention according to claim 3 wherein said orifices and holes are adapted to provide a substantially equal pressure drop across the suction and the pressure side holes.

5. The invention according to claim 1 which further includes a plurality of stand-offs disposed between the suction wall and the suction side baffle to space the baffle apart from the wall.

6. The invention according to claim 1 which further includes a plurality of stand-offs disposed between the pressure wall and the pressure side baffle to space the baffle apart from the wall.

7. The invention according to claim 1 wherein said airfoil shaped member has a second hollow cavity located downstream of the first hollow cavity and wherein the downstream cavity has disposed therein a plate-like pressure side baffle which is spaced closely apart from the pressure side wall forming a pressure side chamber between the pressure side baffle and the pressure side wall wherein cooling air is flowable from the downstream cavity to pressure side holes leading from the formed pressure side chamber, and a plate-like suction side baffle which is spaced closely apart from the suction side wall forming a suction side chamber between the suction side baffle and the suction side wall wherein cooling air is flowable from the downstream cavity to suction side holes leading from the formed suction side chamber.

8. The invention according to claim 7 which further includes means for establishing a cooling air pressure within the pressure side chamber which is in excess of the pressure within the suction side chamber.

9. The invention according to claim 8 wherein said means for establishing a cooling air pressure within the pressure side chamber which is in excess of the pressure within the suction side chamber includes a multiplicity of impingement cooling orifices disposed within said pressure side baffle and said suction side baffle which are sized and spaced relative to the pressure side holes and suction side holes respectively to obtain said difference in pressure between the pressure side chamber and the suction side chamber.

10. The invention according to claim 9 which further includes means for establishing a cooling air pressure in the pressure side and suction side chambers of the first hollow cavity which exceed the respective cooling air pressures in the pressure side and suction side chambers of the downstream hollow cavity.

* * * * *

UNITED STATES PATENT OFFICE

CERTIFICATE OF CORRECTION

PATENT NO. : 4,063,851

DATED : December 20, 1977

INVENTOR(S) : HOWARD AUBREY WELDON

It is certified that error appears in the above-identified patent and that said Letters Patent are hereby corrected as shown below:

Column 3, line 36: before "and" change "26" to read -- 36 --.

Signed and Sealed this

Second Day of May 1978

[SEAL]

Attest:

RUTH C. MASON
Attesting Officer

LUTRELLE F. PARKER
Acting Commissioner of Patents and Trademarks